US006443260B1

(12) United States Patent
Katz et al.

(10) Patent No.: US 6,443,260 B1
(45) Date of Patent: Sep. 3, 2002

(54) STEP LADDER TRAY

(75) Inventors: Gary E. Katz, Mesa; Marvin Teutsch, Phoenix, both of AZ (US)

(73) Assignee: Ladder Mate Corporation, Mesa, AZ (US)

( * ) Notice: Subject to any disclaimer, the term of this patent is extended or adjusted under 35 U.S.C. 154(b) by 0 days.

(21) Appl. No.: 09/679,140

(22) Filed: Oct. 3, 2000

Related U.S. Application Data

(60) Provisional application No. 60/173,891, filed on Dec. 29, 1999.

(51) Int. Cl.[7] ..... E04G 1/00; E04G 3/08; B65D 85/28

(52) U.S. Cl. ..... 182/129; 248/238; 206/372

(58) Field of Search ..... 182/129; 248/238, 248/210; 206/372, 373

(56) References Cited

U.S. PATENT DOCUMENTS 4,310,134 A * 1/1982 Schopp et al. ..... 248/210
4,653,713 A * 3/1987 Hamilton ..... 182/129 X
5,333,823 A * 8/1994 Joseph ..... 182/129 X
5,503,245 A * 4/1996 Etesam ..... 182/129
5,505,302 A * 4/1996 Ferley ..... 182/129 X
5,573,081 A * 11/1996 Bartnicki et al. ..... 182/129
5,603,405 A * 2/1997 Smith ..... 182/129 X
5,813,530 A * 9/1998 Kornblatt ..... 182/129 X
5,873,433 A * 2/1999 Katz ..... 182/129
5,882,097 A * 3/1999 Kohagen et al. ..... 206/372 X
5,913,380 A * 6/1999 Gugel et al. ..... 182/129
5,941,344 A * 8/1999 Spadaro ..... 182/129
5,971,102 A * 10/1999 Brown ..... 182/129
6,267,238 B1 * 7/2001 Miller et al. ..... 206/372 X

* cited by examiner

*Primary Examiner*—Daniel P. Stodola
*Assistant Examiner*—Hugh B. Thompson
(74) *Attorney, Agent, or Firm*—Gregory J. Nelson

(57) ABSTRACT

An accessory securable to the top cap of a step ladder for temporary storage of tools, parts and the like. The accessory includes a support which is securable to the top cap by various clamping arrangements which may include bolts, springs or tie downs. A tray member is pivotally attached to the support and in a deployed position extends horizontally forwardly. In a folded or storage position, the tray member is in overlying registry with the top cap of the ladder. In an alternate embodiment, the support is adjustable to accommodate step ladder caps of varying dimensions.

9 Claims, 5 Drawing Sheets

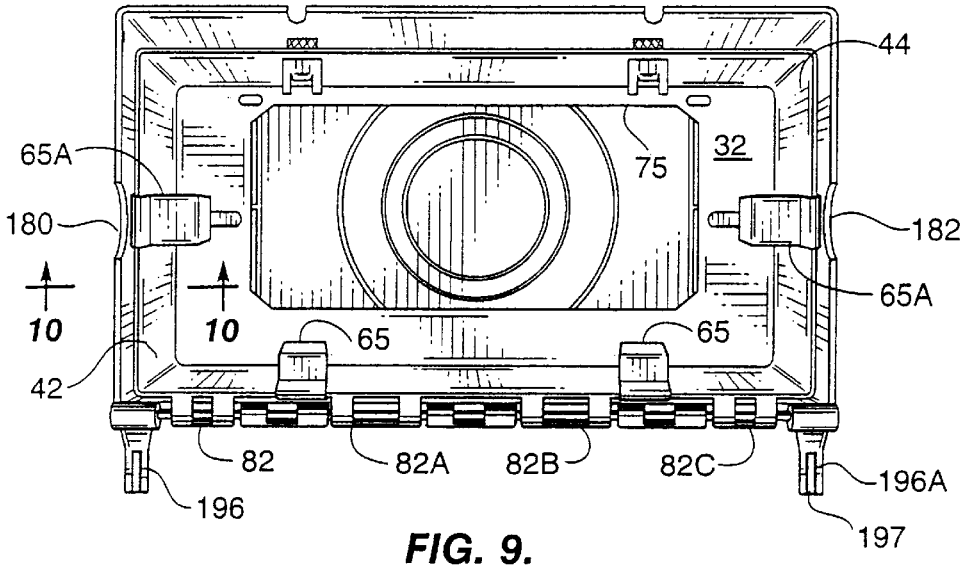
FIG. 9.
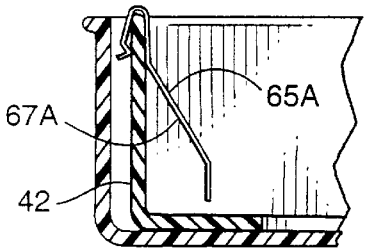
FIG. 10.
FIG. 11.
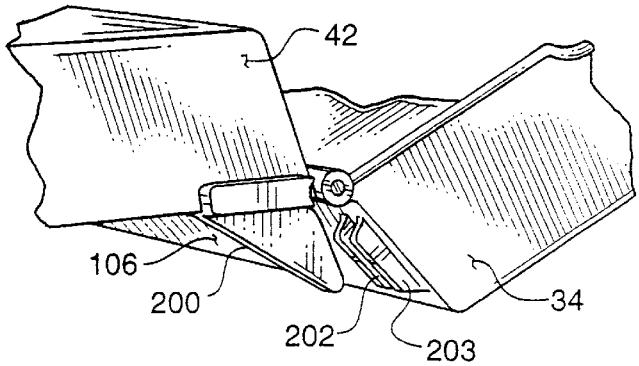

30
34
32

30
20
"L"

30
34
32
20
"L"

34
32
30
"L"

30
"L"

STEP LADDER TRAY

This is a regular application based on Provisional Application Ser. No. 60/173,891, filed Dec. 29, 1999, entitled "Step Ladder Tray."

FIELD OF INVENTION

The present invention relates to an accessory for a step ladder and more particularly relates to a tray assembly which is detachably securable to the top cap of a step ladder to receive and temporarily store items such as tools, parts, paint containers and the like.

BACKGROUND OF THE INVENTION

When working from a step ladder, it is convenient for the worker to have tools, paint cans and other items required for a task readily accessible in a location where they can be conveniently stored and retrieved allowing the worker free use of both hands when working. In recognition of this need, there are various types of accessories available in the prior art which are integrally attached or are securable to a ladder for receiving tools and other items. The most common device of this type is the conventional foldable tray or platform attached to the front support legs of a ladder and which tray may then be pivoted to an out-the-way position when not in use or when the ladder is stored. Other ladder trays or articles holders attachable to a ladder can be found in the prior art and the following are representative:

U.S. Pat. No. 4,261,435 shows a tray with a clip and wire frame support for secure mounting on the top of a step ladder. The tray is shaped to hold tools and has small pockets for containment of small items.

U.S. Pat. No. 5,501,753 shows a paint can holder with a collar which suspends a paint can to facilitate painting directly from the can. The device is attached or supported from the top of a step ladder.

U.S. Pat. No. 3,991,961 shows a mounting bracket which carries a pivot which, in turn, supports a holder such as a collapsible bag. The device is not specifically for use with a ladder and may be attached to a window sill or ledge to assist in such tasks as washing windows. When not in use, the holder may be rotated so that it may be positioned out of the way.

U.S. Pat. No. 4,300,740 shows a movable shelf for a step ladder. The shelf has a pair of brackets which, for example, may engage the edge and underside of either a step or the top of a ladder. Stop members in the form of pins may be engaged to prevent the shelf from sliding when in place.

U.S. Pat. No. 2,444,096 shows a paint receptacle for use with roller-type applicators having a tray which is supported by a foot which engages the top of the step ladder.

U.S. Pat. No. 4,460,063 shows a step ladder work bench which is hingedly attached to a step ladder, allowing it to be raised and hooked in place for use and lowered against the step ladder rails for storage.

U.S. Pat. No. 5,873,433 shows an improved accessory tray securable to the top cap of the step ladder for the temporary storage of tools, parts, and the like. The accessory tray includes a support which is securable to the top cap step ladder by various clamping arrangements which may include bolts, springs or tie downs. The tray is attached to the support and in the deployed position extends horizontally forward from the front steps of the ladder. In a folded or stored position, the tray is overlying in registry with the top cap of the ladder.

The foregoing represents various types of shelves and support trays for tools, paint cans and which are adaptable for use with step ladders.

Accordingly it is a primary object of the present invention to provide an improved step ladder accessory tray which is easy and convenient to use.

Another object of the present invention is to provide a ladder-mounted convenience tray for receiving tools, articles and even paint cans, which tray may be folded to an out-of-the-way position overlying the top cap of the step ladder.

Another object of the present invention is to provide an article-receiving tray attachable to a step ladder which provides the user a convenient receptacle for tools, paints and other articles which the user may require for a task and which tray allows the free use of both hands when performing tasks.

Another object of the present invention is to provide a ladder tray which has a universal mounting so that it may be accommodated on most conventional step ladders.

Another object of the present invention is to provide a ladder tray that can be fabricated from plastic and which has a design that lends itself to injection molding technology.

Another object is to provide a ladder tray which when open is designed to provide a stable supporting surface.

BRIEF SUMMARY OF THE INVENTION

Briefly, the present invention provides a ladder tray assembly which has a base which is securable to the top cap of a step ladder and a tray is hinged to the base. The base is secured to the ladder cap by attachments, which may include springs or clamps. The forward edge of the base extends along the forward edge of the ladder cap and carries a hinge section. The tray has complimentary hinge sections and a hinge pin extends through the hinge sections of the base and tray when they are in registry so the tray may pivot between a stored and deployed position. When the tray is in the deployed or use-position, the tray extends generally horizontally forwardly from the front legs of the step ladder. A flange at opposite sides of the tray abuts an edge of the base or tray section to stabilize the tray in the horizontal position and to transfer the weight load to the base and ladder top cap.

The tray assembly is dimensioned to accommodate work articles such as screws, nails and may include recesses or compartments for these articles as well as for containers such as paint cans of various sizes. The tray will also accommodate elongate items such as pipes and fluorescent light tubes. When not in use, the tray may be folded to a stored position in which the bottom of the tray overlies the base in a nested position so that the tray is out-of-the-way and does not interfere with storage and use of the ladder.

BRIEF DESCRIPTION OF THE DRAWINGS

FIG. 9 is a bottom view of the tray showing the tray in a folded position;

FIG. 10 is a sectional view taken along line 10—10 of FIG. 9;

FIG. 11 is a detail view of a corner of the base and tray showing an alternate construction.

DETAILED DESCRIPTION OF THE DRAWINGS

Figure 1:
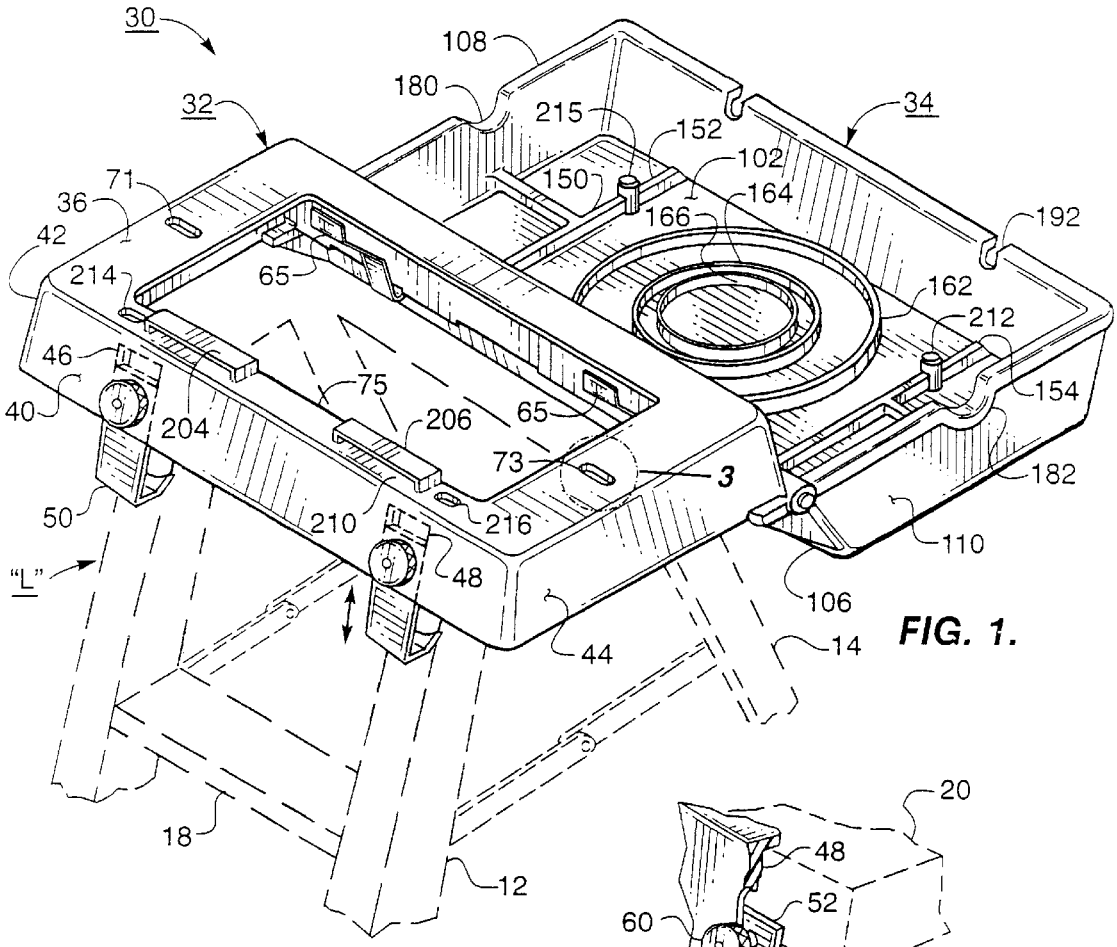
FIG. 1 is a perspective view of the top portion of the step ladder showing the tray assembly of the present invention attached to the ladder with the tray shown in a deployed position.

Turning now to the drawings, particularly FIGS. 1 to 10, a conventional step ladder "L" is shown having two pair of legs 12 and 14. As is conventional, the legs 12 are secured to a cap 20 at their upper ends and legs 14 are pivotally secured to the cap 20 so that the ladder may be folded to compact condition for the convenience of storage when not in use. The ladder is provided with a plurality of rungs or steps 18 extending between the legs 12, the number depending upon its height, one step 18 being shown as representative.

The top cap 20 has a generally rectangular planar upper surface and may have depending edges. The cap 20 may be various sizes depending upon the specifications of the manufacturer of the ladder. Good safety practice cautions that the top cap should not be used as a support surface on which the user stands, therefore the top cap 20 provides a convenient location for the attachment for the ladder tray 30 of the present invention.

Figure 6:
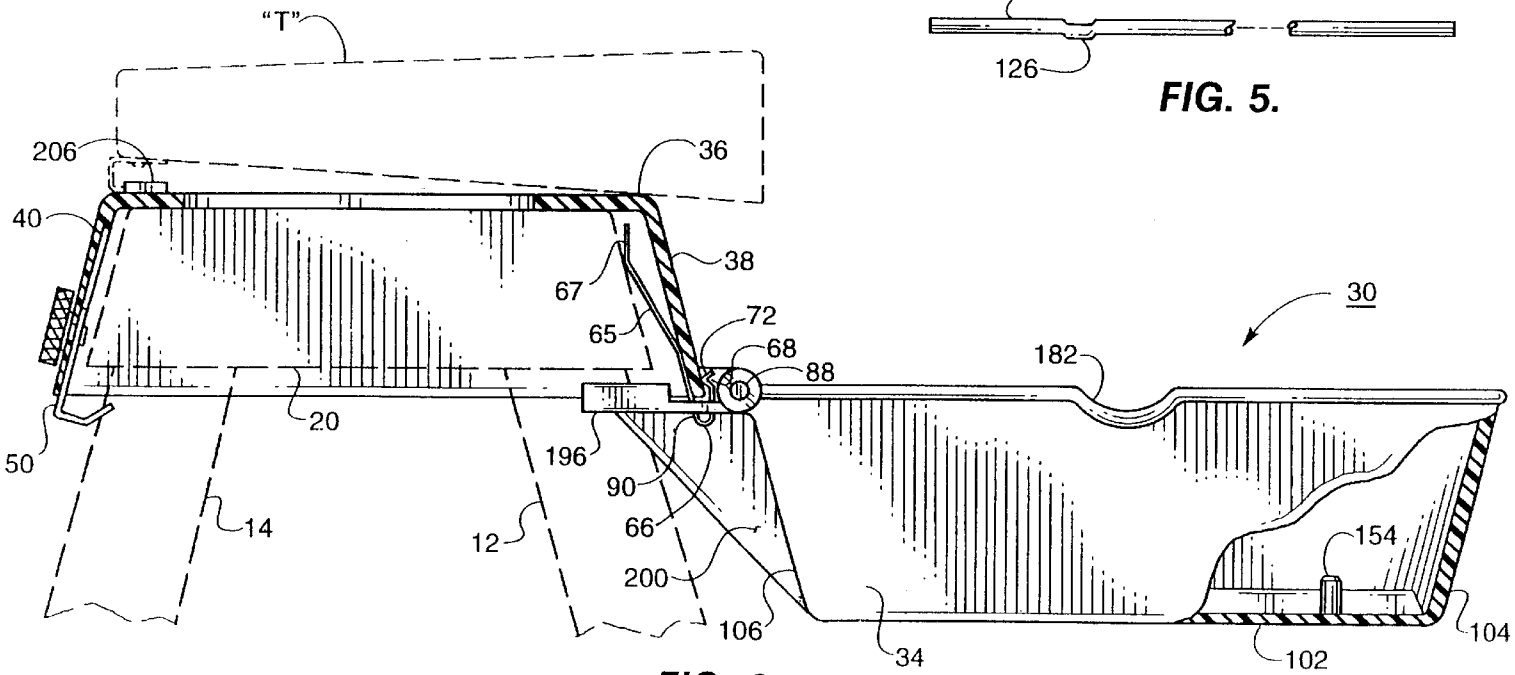
FIG. 6 is a side view partly in section with the tray shown deployed.
Figure 7:
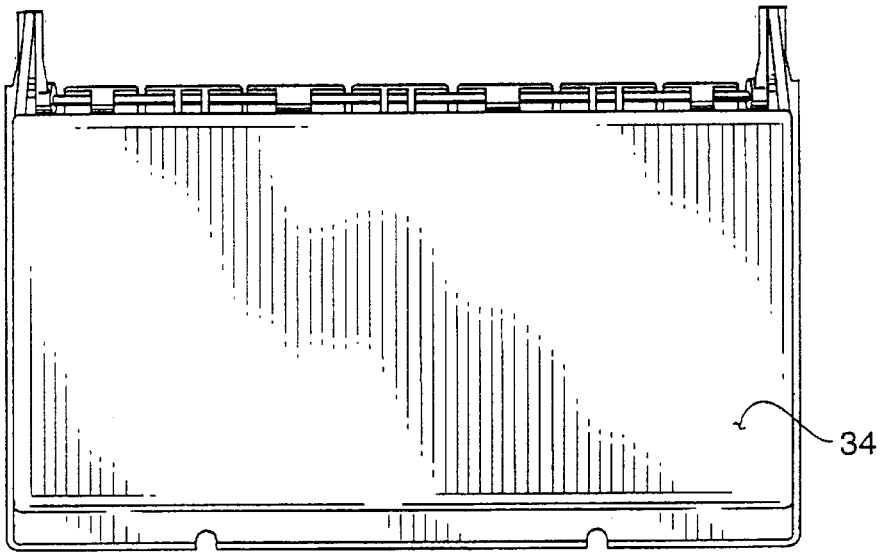
FIG. 7 is a top view showing the tray in a stored position.

The ladder tray assembly 30 includes a base 32 and a tray 34. The base is shown as being generally rectangular having top surface 36 from which depends front wall 38, rear walls 40, and opposite side walls 42 and 44. The front and rear walls 38, 40 diverge slightly outwardly as best seen in FIG. 6. The base 32 is preferably fabricated from a suitable strong plastic by injection molding although metal or fiberglass may also be used.

A pair of recesses 46 and 48 are provided on the inner surface of rear wall 40 at spaced-apart locations near the lower edge of the wall 40. The recesses 46, 48 are adapted to receive clamps 50 as best seen in detail and in FIGS. 1, 2 and 2A. The clamps 50 each have a strap 52, which are bent at an edge to form a lip 54. The straps each define a threaded stud 56 which receives a knurled thumb nut 60 and a washer, not shown. The particular shape of the clamp can vary in accordance with the dimensions and shape of the ladder cap. The clamps 50 are vertically adjustable in the recesses and once adjusted, the lip 54 can be "snugged" against a surface of the ladder cap 20, as seen in FIG. 2. The clamp is secured in place by tightening the thumb nut 60. The clamp may be placed in an inverted position as seen in FIG. 2A to accommodate mounting the tray assembly 30 on older style ladders of the type having a planar top cap with the top cap positioned between the clamp lip 54 and inner surface of the base. The nuts 60 may be provided with a sharp projection on their inner surfaces which will frictionally engage the plastic tray when tightened to prevent the nuts from "backing off."

The base 32 is designed having a width and length to allow it to be positioned over the top cap of the ladder. As discussed above, the base is secured by clamps 50 along the front edge of the cap so the lower lip 54 engages in the lower surface of the top cap. The tray base 32 is further held in place against the top cap by one or more springs 65 as seen in FIGS. 6 and 9. The springs 65 are formed having a lower U-shaped section 66 which terminates at a retainer section 68. The springs are secured to the lower edge of wall 38 and retained by engagement of retainer section 68 with the lower edge. Retainer section 68 of the spring terminates at inwardly bent end 72. Spring arm 67 extending along the interior of wall 38 exerts a spring force against the top cap 20 as best shown in FIG. 6. The springs 65 are made from suitable material such as stainless or spring steel.

Figure 3:
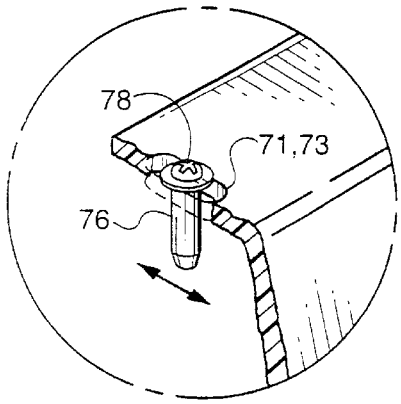
FIG. 3 is a detail view of a portion of FIG. 1 indicated by the numeral 3.

To provide lateral adjustment to accommodate top caps having varying widths, a pair of slots 71, 73 are provided in the tray base at either side of cut-out area 75. Cut-out area 75 reduces the weight of the tray assembly. As seen in FIG. 3, slots 71, 73 receive spacers 76 which are laterally slidable in their respective slots. The spacers may be removed entirely if not required or may be positioned to engage the opposite sides of the ladder cap and secured by screws 78.

Alternatively, springs 65A, similar to springs 65 described above, may be used to accommodate ladder caps of different widths. As seen in FIGS. 9 and 10, springs 65A are secured to the opposite sides 42 and 44 of the base so the associated spring arms 67A will exert a retaining force against the sides of the ladder cap.

Figure 4:
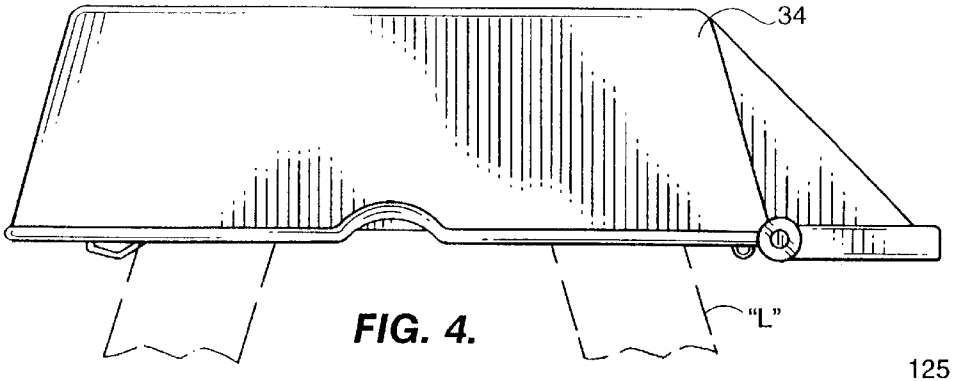
FIG. 4 is a side elevational view showing the tray assembly of the present invention positioned to the top cap of a step ladder with the tray in a stored position.

The tray 34 may be any convenient shape but is generally shown as rectangular having a bottom 102, front wall 104, rear wall 106, and opposite side walls 108 and 110. The tray is also preferably a molded plastic article formed by injection molding. The tray 34 is dimensioned so as to have width and length to allow it to be nested in an inverted nested position overlying the base 32 and ladder cap when in a stored position, as seen in FIGS. 4 and 9. This allows the tray to easily be deployed in the use position and in a stored position folded out of the way for convenience and compactness.

Figure 8:
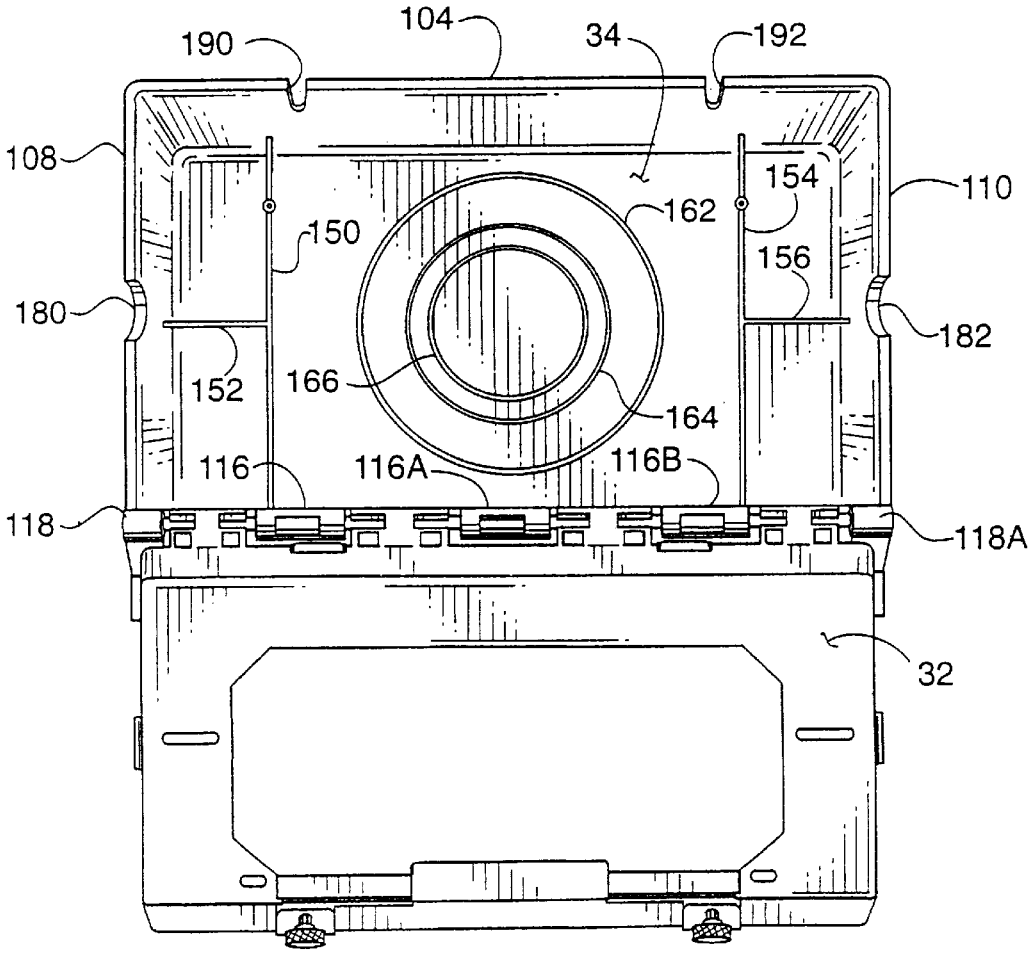
FIG. 8 is a top view showing the tray in a deployed position.

To accommodate folding, as seen in FIGS. 8 and 9, the forward edge of the front wall 38 of the base is provided with a plurality of space-apart, integrally formed hinge barrels 82, 82A, 82B and 82C. The hinge barrels each define bores 88.

Figure 5:
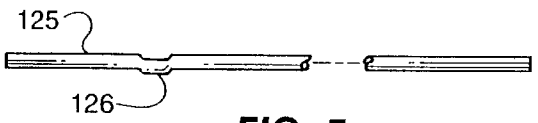
FIG. 5 is a detail view of the hinge pin.

The rear wall of the tray carries a plurality of intermediate hinge barrels 116, 116A and 116B. Hinge barrels 118 and 118A are located at opposite edges of the tray. Hinge barrels 116, 116A, 116B, 118, and 118A are spaced-apart to align with hinge barrels 82 to 82C on the base. When the hinge barrels are aligned they define an elongate bore 88 which receives hinge pin 125 so that the tray may be pivoted relative to the base. The hinge pin 125 is seen in FIG. 5 in the form of an axial rod which may be provided with an off set section 126 so it can be snapped into place in the aligned hinge barrels to pivotally secure the tray to the base.

Figure 2:
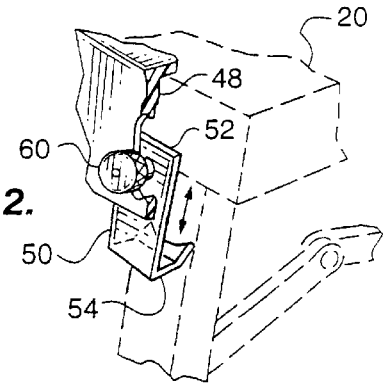
FIG. 2 is a detail view of one of the tray assembly clamps.
Figure 2A:
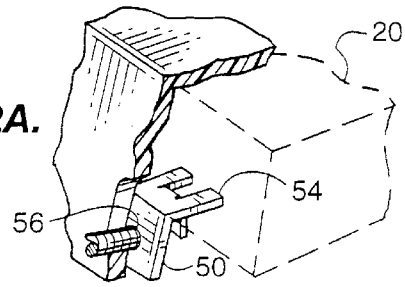
FIG. 2A is a view similar to FIG. 2 with the tray clamp reversed.

As best seen in FIGS. 1 and 8, tray 34 includes partition walls 150, 152, 154 and 156 which form compartments in the tray section to be used for receiving items as nails and screws. The tray also includes circular ridges 162, 164 and 166 in the bottom wall. The ridges define areas for receiving and stabilizing containers as such items paint cans of various sizes such as pints, quarts and gallons.

For the further convenience of the user, the side walls 108, 110 of the tray each define arcuate recesses 180 and 182. The arcuate recesses are at an immediate location along the upper edge of the side walls 108, 110 and are aligned so that a tubular article such as a section of pipe or a fluorescent lamp can be positioned across the section and retained so it can not easily roll off the tray. The front wall 104 of the tray is provided with spaced-apart notches 190 and 192 which are dimensioned to receive a conventional heavy duty power cord. The cord my extend to the desired length providing working length and engaged in one of the recesses which serve to anchor the cord preventing it from slipping and becoming taut particularly when a power tool is being used.

To further stabilize the tray in a horizontal position when it is deployed, an opposite pair of flanges 196, 196A extend from wall 106 of the tray at opposite sides of the tray. The flanges align with the lower edge of the walls 108, 110 and are each reinforced by a gusset plate 200. As seen in FIGS. 1 and 6, the upper surface of the flanges 196, 196A engage the lower edge of walls 42, 44 respectively, in the deployed position. Preferably, the flanges each define slots 197 in which the base walls seat. The tray will deploy to a horizontal position in which the tray and contents are supported by the structure of the end walls. The weight of stored items is also transferred by the flanges and clamps 50 to the ladder top cap.

In FIG. 11, flanges 201 are shown depending from sides 42, 44 of the base. The flanges engage slots 202 between ribs 203 on the rear wall 106 of the tray to support the tray and its contents in the deployed condition. The weight of the tray and its contents will be transferred to the base and ladder top cap.

To maintain the tray in the folded position when stored or during shipping, pins 212 and 215 are provided on partitions 154 and 150, respectively. These pins are positioned to frictionally engage holes 214 and 216 in surface 36. Applying a pivoting force will release the frictionally engaged locking pins from their slots.

Additional convenience features are provided to the user in the form of tabs 204 and 206 which are provided on the exterior surface of the base near the rear wall. The tabs each define a slot 210 which is dimensioned to receive the portion of the rear U-shaped legs of the conventional paint tray. Thus the leg of a paint tray "T" can be engaged in the slots as seen in FIG. 4 to prevent it from slipping.

Figure 12:
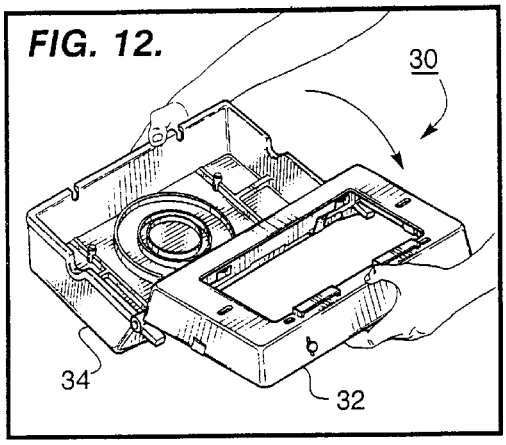
FIGS. 12 to 16 show the installation and use of the tray.
Figure 13:
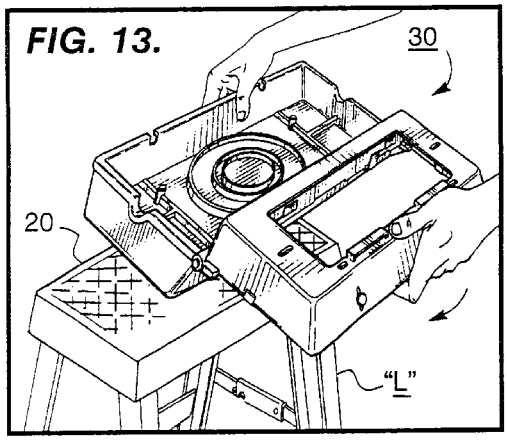
Figure 14:
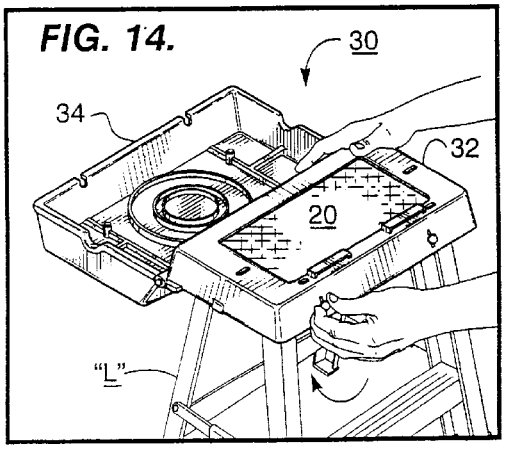
Figure 15:
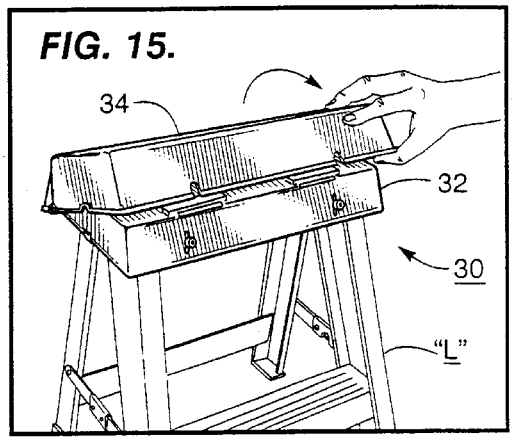
Figure 16:
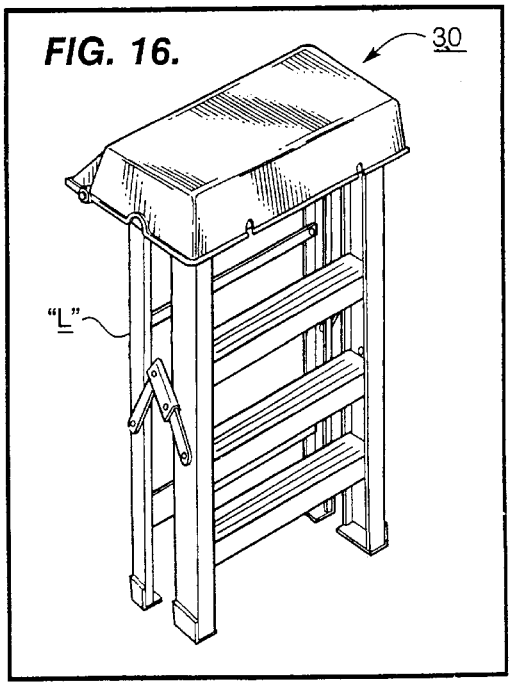

FIGS. 12 to 16 show the use and installation of the tray assembly. The tray assembly is opened as seen in FIG. 12, placed on the ladder cap 20, as seen in FIG. 13 and 14. FIGS. 15 and 16 illustrate the storage position.

The foregoing present invention provides an accessory which is easily adapted and installed on most conventional step ladders and once mounted on the ladder provides an article receptacle for tools, hardware and even paint containers. Referring to FIGS. 12 to 16, the tray assembly is opened. Once opened, it is positioned on the ladder top cap and secured in place by the clamps and springs. Once in position, the tray is stable and the tray items are securely supported by the extending flanges 196. While the tray may be made of various materials, it is preferably made of a light weight plastic material and injection molded or fabricated by other techniques.

The use, it is relatively easy to attach to the step ladder. The tray can be deployed by pivoting the tray forward from the stored position to the use position. When the tray is not required to be used, all loose items are removed and it can be pivoted to a position overlying the top cap and the base support so it does not interfere with the normal use of the step ladder. In the stored position the tray is frictionally secured to the base by the engagement of pins 212 and 215 in the associated slots 216 and 214.

While the principles of the invention have been made clear in the preferred embodiment set forth above, it will be obvious to those skilled in the art to make various modifications to the structure, the arrangement and the components described, to the extent that these various modifications do not depart from the spirit and scope of the claims, and are intended to be encompassed therein.

We claim:

1. An article receiving and storage device for use in association with a step ladder having a first pair of front legs, a second pair of step-supporting legs and a top cap with an upper surface, said article receiving and storage device comprising:

(a) a base having a top, a front wall, a rear wall, and opposite side walls depending from said top, each wall having a lower edge, said base having a hollow interior being dimensioned to matingly receive therein the top cap of said ladder in an installed position;

(b) a tray having a bottom wall, front wall, rear wall and side walls and defining a storage compartment;

(c) a hinge connecting the said front wall of the base and said rear wall of the tray whereby said tray is adapted to be pivoted from a position with said compartment enveloping the top of said base to a deployed position with the tray extending forwardly from said top cap;

(d) one of said tray and base including a support extending from a wall thereof and engageable with a wall of the other one of said tray and base; and (e) clamp means on said base engageable with the ladder top cap.

2. The device of claim 1 wherein said base and tray are plastic.

3. The device of claim 1 wherein said opposite tray side walls are formed with aligned recesses.

4. The device of claim 1 wherein said base top wall has tabs defining slots spaced for receiving the legs of a paint tray.

5. The device of claim 1 further including biasing means associated with the interior of one of said base front or rear walls positioned to exert a retaining force against said ladder top cap in an installed position.

6. The device of claim 1 wherein said hinge comprises aligned hinge barrels on said tray and base having bores receiving an axial hinge pin, said hinge pin having an offset section to retain it in place.

7. The device of claim 1 including a pair of supports extending from said tray and each aligned with one of the side walls of the base and each defining a slot cooperative to engage the lower edge of the associated side wall of the base in the deployed position.

8. The device of claim 1 including locking means on said tray frictionally cooperable with locking means on said base to secure said device in a folded position when not in use.

9. The device of claim 1 further including an adjustable spacer associated with said base to engage the sides of the top cap.

* * * * *